US006387229B1

(12) United States Patent
Cornelius Verberne

(10) Patent No.: US 6,387,229 B1
(45) Date of Patent: May 14, 2002

(54) ALLOY PLATING

(75) Inventor: Wilhemus Maria Johannes Cornelius Verberne, s-Hertogenbosch (NL)

(73) Assignee: Enthone, Inc., West Haven, CT (US)

( * ) Notice: Subject to any disclaimer, the term of this patent is extended or adjusted under 35 U.S.C. 154(b) by 0 days.

(21) Appl. No.: 09/549,850

(22) Filed: Apr. 14, 2000

(30) Foreign Application Priority Data

May 7, 1999 (GB) ..... 9910681
Mar. 28, 2000 (GB) ..... 0007495

(51) Int. Cl.[7] ..... C25C 3/30
(52) U.S. Cl. ..... 204/245; 204/244
(58) Field of Search ..... 205/244, 245

(56) References Cited

U.S. PATENT DOCUMENTS

| | | | | |
|---|---|---|---|---|
| 3,642,591 A | | 2/1972 | Boose et al. | |
| 3,980,532 A | | 9/1976 | Abbott | |
| 3,980,533 A | | 9/1976 | Abbott | |
| 4,659,631 A | | 4/1987 | Kurimoto et al. | |
| 5,075,202 A | * | 12/1991 | Koboshi et al. | 430/372 |
| 5,236,565 A | | 8/1993 | Muller et al. | |
| 5,405,523 A | * | 4/1995 | Eckles | 205/245 |

FOREIGN PATENT DOCUMENTS

| | | | |
|---|---|---|---|
| DE | 4005112 | A | 6/1991 |
| EP | 0253942 | A1 | 1/1988 |
| EP | 0694631 | A1 | 1/1996 |
| EP | 0751240 | A1 | 1/1997 |
| EP | 880310 | A1 | 11/1998 |
| GB | 2077764 | A | 12/1981 |
| JP | 78013583 | B | 5/1978 |
| JP | 59038399 | | 6/1984 |
| RO | 113061 | B1 | 3/1998 |
| RO | 113062 | B1 | 3/1998 |
| SU | 571376 | A | 9/1977 |
| WO | WO83/03266 | | 9/1983 |

* cited by examiner

*Primary Examiner*—Edna Wong
*Assistant Examiner*—Thao Tran
(74) *Attorney, Agent, or Firm*—Senniger, Powers, Leavitt & Roedel

(57) ABSTRACT

There is disclosed an electroplating bath for depositing zinc/manganese alloys on a substrate characterized in that it comprises an aqueous bath free or substantially free of ammonium halide and of fluoroborate which is made up from 10–150 g/l, alkali metal salt, 30–90 g/l boric acid, 10–200 g/l water soluble zinc salt, 10–50 g/l water soluble manganese salt, 60–140 g/l alkali metal gluconate or tartrate and a base e.g. an alkali metal hydroxide to bring the pH to the range 6.1–7.1.

15 Claims, No Drawings

ALLOY PLATING

BACKGROUND OF THE INVENTION

The present invention relates to the deposition of alloy deposits of zinc/manganese alloys from electroplating baths which are at acid pH values close to neutral.

The problem with which the present invention is concerned is to obtain electrodeposits which have high contents of manganese, namely above 9% by weight, but which can be produced without the use of acid ammonium chloride or fluoroborate in the plating bath; these two ingredients being undesirable on environmental grounds.

In addition the process must be able to plate components satisfactorily.

German OLS 2012774 describes a zinc plating process in which the plating bath contains 16.5 g zinc sulphate heptahydrate, 110 g sodium gluconate, 70 g boric acid, 100g anhydrous sodium sulphate, 13 g sodium hydroxide, 0.2 g benzaldehyde and water to make up to one litre, the pH being 6.8. There is no reference to any alloying ingredients being present.

The prior art processes for plating zinc/manganese alloys contain ammonium chloride at acid pH's. We have attempted to replace the ammonium chloride by alkali metal chloride but found that this did not produce adequate amounts of manganese in the deposits.

Surprisingly we have found that if one uses alkali metal salts with gluconate or tartrate high contents of manganese can be obtained in the electrodeposit.

BRIEF SUMMARY OF THE INVENTION

Thus according to the present invention an electroplating bath for depositing zinc/manganese alloys on a substrate comprises an aqueous bath free or substantially free of ammonium halide and of fluoroborate which is made up from 10–150 g/l alkali metal salt, preferably 25–100 g/l, preferably a sulphate 40–90 g/l boric acid, preferably 50–80 g/l, 10–200 g/l water soluble zinc salt, preferably 10–100 g/l, more preferably 20–40 g/l, when the alkali metal salt is a halide and 20–200 g/l, preferably 45–100 g/l when the alkali metal salt is a sulphate, 10–50 g/l water soluble manganese salt, preferably 20–40 g/l, 60–140 g/l alkali metal gluconate or tartrate, preferably 110–130 g/l, and alkali metal hydroxide to bring the pH to the range 6.1 to 7.2, preferably 6.1 to 7.0, more preferably 6.3–6.9.

DETAILED DESCRIPTION OF THE INVENTION

The alkali metal salt can be any such material but the sodium and potassium chlorides or sulphates are the most economical and effective and the sulphates are preferred.

The water soluble zinc salt may be any of those used to electrodeposit zinc but zinc sulphate is preferred.

The water soluble manganese salt may be any of those used to electrodeposit manganese but manganese sulphate, which may be hydrated, is preferred. The zinc and the manganese can be added to the plating bath in the form of salts other than the sulphates for example as sulphamates, methane sulphonates, gluconates, tartrates, acetates, formates, or carbonates. When carbonates are added to acid systems carbon dioxide will be released. This can be a way of avoiding the concentration of the sulphate conductivity salt rising to too high a level. Fairly high concentrations can have benefits in producing more even thickness distribution of the deposit as between high and low current density areas.

Gluconic and tartaric acids are hydroxy carbonic acids, and have been found effective as complexing agents for these systems, however citric acid does not seem to give good results. Other polyhydroxy compounds such as sorbitol might be expected to five stable complexes with zinc, as would amines such as tetra methylene pentamine or EDTA. Triethanolamine does not seem to be able to form a stable complex with zinc in this system.

Additional ingredients which may be added include grain refiners if desired. Water soluble surfactants and polymers are well known in this art for this function and appropriate such materials may be added.

In a preferred form of the invention an electroplating bath is characterised in that it contains benzaldehyde as bisulphite in amount of 50 to 500 mg/l, preferably 100 to 300 mg/l, more preferably 175 to 225 mg/l e.g. about 200 m/l. In another preferred form of the invention an electroplating bath is characterised in that it contains trimethylolpropane in an amount of 1 to 50 g/l, preferably 5 to 25 g/l, more preferably 7.5 to 15 g/l e.g. about 10 g/l.

The bath composition preferably comprises

15–170 g/l of salt anions preferably halide or sulphate anions, preferably 75–140 g/l, more preferably 80–120 g/l, 4–50 g/l zinc ions, preferably 10–18 g/l, 3–16 g/l of manganese ions, preferably 6–13 g/l, 35–90 g/l of borate ions, preferably 60–80 g/l, 50–150 g/l of gluconate or tartrate ions, preferably 80–130 g/l, and preferably 175 to 225 mg/l of benzaldehyde as bisulphite, or 7.5 to 15 g/l of trimethylolpropane.

a pH in the range 6.1 to 7.2, preferably 6.1–7.0, more preferably 6.3–6.9.

One specific embodiment of the invention is the following bath composition 30 g/l zinc chloride, which provides 14.4 g/l of zinc ions and 15.6 g/l of chloride ions, 31 g/l manganese sulphate monohydrate, which provides 10.1 g/l of manganese ions and 17 g/l of sulphate ions, 100 g/l potassium sulphate, which provides 55 g/l of sulphate ions and 45 g/l of potassium ions, 60 g/l boric acid, which provides 57 g/l of borate ions, 120 g/l sodium gluconate, which provides 107 g/l of gluconate ions and 13 g/l of sodium ions, pH adjusted to 6.5 with sodium or potassium hydroxide.

A preferred specific embodiment of the invention is the following bath composition 65 g/l zinc sulphate heptahydrate, which provides 14.4 g/l of zinc ions and 21.7 g/l of sulphate ions, 30 g/l manganese sulphate monohydrate, which provides 9.8 g/l of manganese ions and 6.5 g/l of sulphate ions, 100 g/l potassium sulphate, which provides 55 g/l of sulphate ions and 45 g/1 of potassium ions, 75 g/l boric acid, which provides 71.3 g/l of borate ions, 120 g/l sodium gluconate or sodium tartrate, which provide 107 g/l of gluconate ions, and 96 g/l of tartrate ions respectively, pH adjusted to 6.5 with sodium or potassium hydroxide.

Effective plating conditions are room temperature, without agitation, using a zinc anode with a plating current of 2A. However higher or lower temperatures may be used e.g. up to 60° C. or down to 10° C. Agitation may be used if desired. Plating currents in the range 0.5 to 4A may be used.

The invention also extends to passivating compositions for zinc/manganese alloys which unexpectedly give a black passivate and improved corrosion resistance.

Thus according to this aspect of the present invention an aqueous composition for forming a black passivate on the surface of a zinc/manganese electrodeposit is characterised in that it comprises hexavalent chromium, one or more carboxylic acids and a copper sulphate and is free of silver ions. The hexavalent chromium may be provided by a mixture of $CrO_3$ and concentrated sulphuric acid. e.g. it may contain 30 to 70 g/l, preferably 40 to 60 g/l e.g. about 50 g/l of $CrO_3$ and 2 to 15 ml/l, preferably 5 to 10 m/l of 96% $H_2SO_4$.

The composition preferably contains 40 to 100 ml/l, preferably 50 to 70 ml/l, more preferably 60 to 80 ml/l of acetic acid as the carboxylic acid.

The composition preferably contains 10 to 25 g/l of copper sulphate. e.g. $CuSO_4 \cdot 5H_2O$ preferably 14 to 20 g/l more preferably 15 to 18 g/l.

The invention also extends to a method of providing a zinc/manganese alloy electrodeposit with a black passivate which comprises treating the electrodeposit with a passivate composition as claimed herein. Preferably the zinc/manganese electrodeposit contains 14 to 20% by weight of manganese.

The invention also extends to a zinc/manganese electrodeposit especially one made in accordance with the present invention whenever provided with a black passivate finish by a method as claimed herein.

The invention may be put into practice in various ways and a number of specific embodiments will be described with reference to the accompanying examples to illustrate the invention. All references to room temperature mean 25° C.

EXAMPLES 1–8

Electroplating bath compositions were made up from the ingredients set out in Tables 1A and 1B

TABLE 1A

| Example | 1 | 2 | 3 | 4 |
|---|---|---|---|---|
| Ingredient | | | | |
| Zinc chloride g/l | 30 | 30 | 30 | 30 |
| Manganese sulphate. $1H_2O$ g/l | 31 | 31 | 31 | 31 |
| Potassium chloride g/l | 100 | 100 | 100 | 100 |
| Boric acid ($H_3BO_3$) g/l | 60 | 60 | 60 | 60 |
| Sodium gluconate g/l | 120 | 120 | 120 | 120 |
| Cationic polymer ml/l (l) | — | 1.5 | — | — |
| Carboxylated ethoxylated alcohol ml/l (2) | — | — | 24 | — |
| Carbowax 4000 g/l (3) | — | — | — | 4 |
| Sodium benzoate g/l | — | — | 4 | — |
| Benzylidene acetone mg/l | — | — | — | — |

TABLE 1A-continued

| Example | 1 | 2 | 3 | 4 |
|---|---|---|---|---|
| Vanilin mg/l (4) | — | — | — | — |
| Sodium hydroxide to adjust pH to pH | 6.5 | 6.5 | 6.5 | 6.5 |
| Plating temperature ° C. | 25 | 25 | 25 | 25 |

TABLE 1B

| Example | 5 | 6 | 7 | 8 |
|---|---|---|---|---|
| Ingredient | | | | |
| Zinc chloride g/l | 30 | 30 | 30 | 30 |
| Manganese sulphate. $1H_2O$ g/l | 31 | 31 | 31 | 31 |
| Potassium chloride g/l | 100 | 100 | 100 | 100 |
| Boric acid ($H_3BO_3$) g/l | 60 | 60 | 60 | 60 |
| Sodium gluconate g/l | 120 | 120 | 120 | 120 |
| Cationic polymer ml/l (1) | — | — | — | — |
| Carboxylated ethoxylated alcohol ml/l (2) | — | — | — | — |
| Carbowax 4000 g/l (3) | 4 | 4 | 4 | 4 |
| Sodium benzoate g/l | 4 | — | — | — |
| Benzylidene acetone mg/l | — | — | 100 | — |
| Vanilin mg/l (4) | — | — | — | 50 |
| Sodium hydroxide to adjust pH to pH | 6.5 | 5 | 6.5 | 6.5 |
| Plating temperature ° C. | 25 | 53 | 53 | 53 |

Notes on Table 1

(1) ureylene quaternary ammonium polymer. sold as MIRAPOL WT. which contains 64% w/w of the said polymer dissolved in water. Mirapol WT has a CAS number 68555-36-2 and is sold by Rhone-Poulenc and is stated to have the formula

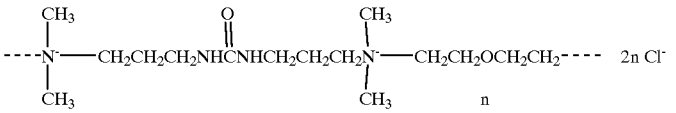

Where n=6(average)

(2) This is supplied as AKYPOLF4 by Kao Corporation as an 86% minumum active ingredient solution in water. The active ingredient is indicated by the supplier to be a mixture of Capryleth-9 carboxylic acid and Hexeth-4 carboxylic acid. (see International Cosmetic Ingredient Dictionary, $6^{th}$ Ed. p 137 and p 445)

(3) Carbowax 400 is 100% w/w polyethylene glycol of MW 3500 supplied as a solid powder by Union Carbide.

(4) The vanilin is added in the form of a bisulphite adduct to bring it into solution.

Each of the baths given in Table 1 were used to plate Hull cell panels in Hull cells, which panels afforded a mild steel substrate and are of flat rectangular shape being 10 cms lone by ×6.7 cms wide.

A zinc anode was used with a plating current of 2A and a plating time of 10 minutes without agitation. In all the tests gassing occurred at the mild steel cathode indicating that the efficiency was less than 100%.

The mild steel Hull cell panels have high, medium and low current density regions and can be considered as having ten regions located from the highest to the lowest current density region along the panel. In the following Table 2 the highest density region will be called region 10 and the lowest density region will be called region 1.

The appearance of the deposits is indicated by the following letter codes which have the meanings given below Table 2.

Alloy compositions are also given for two of the examples namely Examples 4 and 6 at four different positions namely positions 9.7,4 and 2.

TABLE 2

| Example | 1 | 2 | 3 | 4 | 5 | 6 | 7 | 8 |
|---|---|---|---|---|---|---|---|---|
| Panel position | | | | | | | | |
| 10 | bu | bu | bbs | bl | bl | bl | bu | bl |
| 9 | bl | gy | bbs | SB | gr | SB | bu | SB |
| composition % Mn | | | | 28.1 | | 20.6 | | |
| 8 | SB | gy | bbs | SB | gr | SB | bu | SB |
| 7 | SB | gy | bbs | SB | gr | SB | SB | SB |
| composition % Mn | | | | 25.6 | | 18.9 | | |
| 6 | SB | gy | bbs | SB | gr | SB | SB | SB |
| 5 | SB | BR | bbs | SB | SB | SB | SB | SB |
| 4 | SB | BR | SB | SB | SB | SB | SB | SB |
| composition % Mn | | | | 20.7 | | 17.3 | | |
| 3 | gy | BR | SB | SB | SB | SB | SB | SB |
| 2 | gy | BR | SB | SB | SB | SB | SB | bl |
| composition % Mn | | | | 15.3 | | 9.6 | | |
| 1 | gy | BR | BR | BR | BR | bl | BR | bl |

Appearance Codes for Table 2 bu=burnt. bl=black, SB=semi-bright. gy=grey. BR=bright. bbs=bright brown streaky. gr=grainy.

The ranking of these appearances from best to worst is BR>SB>gy>bbs>bl>gr>bu.

The manganese content was determined by cutting a 1 cm by 4 cm sample from the Hull panel. The rear face of the sample is masked and then the deposit is stripped off with 40 ml of hydrochloric acid (500 ml/l HCl 35% and 500 ml/l water). This solution is then diluted down to 100 ml with demineralized water. Induced plasma emission spectroscopy (ICP) is used to determine the zinc and manganese content. Standard apparatus (model OPTIMA 3000 manufactured by Perkin Elmer) is calibrated using standard procedure against a hydrochloric acid blank (20% by volume) and a standard containing 250 mg/l zinc ions and 2.5 mg/l manganese ions in 20% by volume HCl.

The wavelengths for the elements to be measured are selected to have a good sensitivity and to not be interfered with by other elements which may be present. The wavelength for zinc was 206 nm, that for manganese was 279 nm.

As can be seen from Table 2 zinc/manganese electrodeposits containing between 15 and 28% manganese can be obtained. The deposits are generally semibright in appearance, which is useful as a technical finish e.g. for functional components such as fasteners, bolts, screws, nuts and brackets.

It will be noted that the amount of manganese in the deposit is lower at a plating bath temperature of 53° C. than at 25° C.

The solution of Example 1–5 of Table 1 was left to stand open to air in the laboratory for several weeks and it remained clear without any colour changes indicating good stability.

EXAMPLE 9–14

Resistance to corrosion by neutral salt spray testing was carried out on flat plate samples 10×7 cms in area plated in a 2.5 litre beaker having the composition of example 4 above, using a zinc anode of plate form, and mechanical agitation at 25° C. The anode was parallel to the workpiece and 13 cms therefrom. The face of the workpiece which faced the anode was the face exposed to the salt spray. The deposits contained 17 to 21% Manganese, balance zinc and were 10 micrometres thick. Table 3 below gives a comparison of a conventional alkaline zinc deposit with no passivate (ex 9) and with two proprietory passivates PERMAPASS 3080—(a trivalent chromium passivate) (hereafter PP3080) (PERMAPASS is a Trade Mark of Enthone OMI Inc., and is registered in a number of countries) (ex 10) and P2 (MOLYPHOS 66)—(a chrome-free passivate) ( supplied by Centre for Advanced Electroplating, Copenhagen, Denmark) (hereafter P2) (ex 11) and the said sample of example 4 with the same three degrees of passivation (ex 12,13 and 14).

P2 is a chrome free conversion coating in which the ratio of molybdenum to phosphorus is 0.66. The pH is 4.6, and it is used at 60° C. for 3 minutes.

TABLE 3

Neutral salt spray test (1).

| Example | Passivate | Time to Commencement of WCP (2) hrs | Time to 5% WCP (3) hrs | Time to Commencement of RR (4) hrs |
|---|---|---|---|---|
| 9 | none | <24 | 48 | 48 |
| 10 | PP3080 | 24 | 72 | 240 |
| 11 | P2 | 24 | 48 | 48 |
| 12 | none | <24 | <24 | 168 |
| 13 | PP3080 | 48 | 72 | 248 |
| 14 | P2 | 24 | 24 | 168 |

Notes on Table 3

(1) The neutral salt spray test consists of continuously exposing the plated article to a salt fog formed by nebulizing neutral 5% w/w sodium chloride solution at 35° C. using the Standard procedure of ASTM B117.

(2) WCP means white corrosion products and commencement occurs at the edges of the plate.

(3) 5% WCP means that 5% of the area of the plate is covered with WCP (4) RR means red rust. The difference in protection against red rust for the product in accordance with the present invention (Ex 14) of 168 hours is a significant improvement over the prior product (Ex 11) of 48 hours.

Carbowax 4000 was present in each of examples 4–8 and, as can be seen from Table 2, these have the largest extent of semi-bright appearance, and are preferred. Whilst the present invention is not dependent on the accuracy or otherwise of any theory, Carbowax 4000 is believed to act as a grain refiner, which serves to promote the formation of uniform, adherent deposits.

EXAMPLES 15 TO 25

These were made up to develop a chloride free near neutral zinc-manganese plating process. It is anticipated that metal concentration in chloride baths will be a problem. The plating efficiency is less than 100% and a considerable amount of the metal deposited is likely to be manganese rather than zinc. The use of zinc anodes would cause a build-up of zinc. Inert anodes could not be used because they would cause evolution of toxic chlorine gas.

Table 4A below sets out the ingredients and amounts for examples 15 to 18, and Table 4B for examples 19 to 22, and Table 4C for examples 23 to 25.

TABLE 4A

| Example | 15 | 16 | 17 | 18 |
|---|---|---|---|---|
| Ingredient | | | | |
| Zinc chloride g/l | 30 | 30 | — | — |
| Zinc sulphate. $7H_2O$ g/l | — | — | 65 | 65 |
| Potassium chloride g/l | 100 | 100 | — | — |
| Sodium sulphate anhydrous g/l | — | — | 100 | 100 |
| Manganese sulphate. $1H_2O$ g/l | 30 | 30 | 30 | 30 |
| Boric acid ($H_3BO_3$) g/l | 75 | 75 | 75 | 75 |
| Sodium gluconate g/l | 120 | 120 | 120 | 120 |
| Cationic polymer ml/l (1) | — | — | — | — |
| Carboxylated ethoxylated alcohol ml/l (2) | — | — | — | — |
| Carbowax 4000 g/l (3) | 4 | — | 4 | — |
| Sodium benzoate g/l | — | — | — | — |
| Benzylidene acetone mg/l | 25 | 25 | — | — |
| Vanilin mg/l (4) | — | — | — | — |
| PEG 400 g/l (5) | — | — | — | — |
| Pluriol E-1500 g/l (6) | — | — | — | — |
| Lutron HF-1 g/l (7) | — | — | — | — |
| Polymin G-35 g/l (8) | — | — | — | — |
| Potassium thiocyanate g/l | — | — | — | — |
| Sodium allyl sulphonate g/l (9) | — | — | — | — |
| Sodium hydroxide to adjust pH to pH | 6.5 | 6.5 | 6.5 | 6.5 |
| Plating temperature ° C. | 25 | 25 | 25 | 25 |

TABLE 4B

| Example | 19 | 20 | 21 | 22 |
|---|---|---|---|---|
| Ingredient | | | | |
| Zinc chloride g/l | — | — | — | — |
| Zinc sulphate. $7H_2O$ g/l | 65 | 65 | 65 | 65 |
| Potassium chloride g/l | — | — | — | — |
| Sodium sulphate anhydrous g/l | 100 | 100 | 100 | 100 |
| Manganese sulphate. $1H_2O$ g/l | 30 | 30 | 30 | 30 |
| Boric acid ($H_3BO_3$) g/l | 75 | 75 | 75 | 75 |
| Sodium gluconate g/l | 120 | 120 | 120 | 120 |
| Cationic polymer ml/l (l) | — | — | — | 20 |
| Carboxylated ethoxylated alcohol ml/l (2) | — | — | — | — |
| Carbowax 4000 g/l (3) | — | — | — | — |
| Sodium benzoate g/l | — | — | — | — |
| Benzylidene acetone mg/l | — | — | — | — |
| Vanilin mg/l (4) | — | — | — | — |
| PEG 400 g/l (5) | — | — | — | — |
| Pluriol E-1500 g/l (6) | 4 | — | — | — |
| Lutron HF-1 g/l (7) | — | 4 | — | — |
| Polymin G-35 g/l (8) | — | — | 4 | — |
| Potassium thiocyanate g/l | — | — | — | — |
| Sodium allyl sulphonate g/l (9) | — | — | — | — |
| Sodium hydroxide to adjust pH to pH | 6.5 | 6.5 | 6.5 | 6.5 |
| Plating temperature ° C. | 25 | 25 | 25 | 25 |

TABLE 4C

| Example | 23 | 24 | 25 |
|---|---|---|---|
| Ingredient | | | |
| Zinc chloride g/l | — | — | — |
| Zinc sulphate. $7H_2O$ g/l | 65 | 65 | 65 |
| Potassium chloride g/l | 100 | 100 | — |
| Sodium sulphate anhydrous g/l | — | — | 100 |
| Manganese sulphate. $1H_2O$ g/l | 30 | 30 | 30 |
| Boric acid ($H_3BO_3$) g/l | 75 | 75 | 75 |
| Sodium gluconate g/l | 120 | 120 | 120 |
| Cationic polymer ml/l (1) | — | — | — |
| Carboxylated ethoxylated alcohol ml/l (2) | — | — | — |
| Carbowax 4000 g/l (3) | — | — | — |
| Sodium benzoate g/l | — | — | — |
| Benzylidene acetone mg/l | — | — | — |
| Vanilin mg/l (4) | — | — | — |
| PEG 400 g/l (5) | — | — | — |
| Pluriol E-1500 g/l (6) | — | — | — |
| Lutron HF-1 g/l (7) | — | — | — |
| Polymin G-35 g/l (8) | — | — | — |
| Potassium thiocyanate g/l | 6 | — | — |
| Sodium allyl sulphonate g/l (9) | — | 20 | — |
| Sodium hydroxide to adjust pH to pH | 6.5 | 6.5 | 6.5 |
| Plating temperature ° C. | 25 | 25 | 25 |

Notes on Table 4

(1). (2). (3). (4) same as table 1.

(5) PEG 400 is a polyethylene glycol which has a Molecular weight of 400, and is sold by BASF as Pluriol E-400 as a 100% active ingredient liquid.

(6) Pluriol E-1500 is a polyethylene glycol of MW 1500 sold by BASF as a 100% active ingredient liquid.

(7) Lutron HF-1 is a modified polyglycol ether sold by BASF as a 100% active ingredient liquid.

(8) Polymin G-35 is a polyethylene imine of low MW sold by BASF as a 50% w/w active ingredient solution in water.

(9) Added as 300 g/l solution in water.

In Examples 17 to 25 which use sulphate salts rather than chlorides a similar compound to Carbowax 4000 is used namely PEG 400. It has a better solubility in the sulphate bath than does Carbowax 4000.

Water soluble polymers and surfactants are preferred.

Each of the baths given in Tables 4A and 4B were used to plate Hull cell panels in Hull cells, as described for examples 1–8, using a zinc anode with a plating current of 2A and a plating time of 10 minutes without agitation, except for Example 16 which used air agitation. The appearance of the panels was generally semi-bright with some dull areas in the high current density region.

These Hull cell panels were then analysed by the ICP technique described for examples 1–8 and the example number, position of analysis and alloy content are given in Table 5. For each example the table first gives the total content in ppm of zinc plus manganese and then below this the % of manganese, these figures are listed in columns below the position at which the analysis was done namely Hull positions 2.4.7 and 9.

TABLE 5

| Hull position | 2 | 4 | 7 | 9 |
|---|---|---|---|---|
| Example no | | | | |
| 15 | 97.7 | 234.9 | 369.3 | 431.1 |
| 15% Mn | 11.3 | 19.6 | 24.8 | 29.6 |
| 16 | 79.7 | 225.8 | 445.4 | 581.9 |
| 16% Mn | 6.1 | 18.1 | 22.8 | 27.3 |
| 17 | Not tested (1) | | | |
| 17 | | | | |
| 18 | 93.3 | 250.7 | 416.3 | 523.3 |
| 18% Mn | 10.4 | 15.3 | 20.8 | 24.5 |
| 19 | Not tested (2) | | | |
| 19 | | | | |
| 20 | 91.3 | 232.5 | 371.4 | 398.7 |
| 20% Mn | 7.5 | 15.3 | 22.5 | 25.1 |
| 21 | 67.1 | 108.2 | 166.9 | Not tested (3) |
| 21% Mn | 0.4 | 0.5 | 2.3 | |
| 22 | 47.4 | 51.6 | 196.8 | Not tested (3) |
| 22% Mn | 0.4 | 1.7 | 19.6 | |
| 23 | 133.9 | 278.6 | 331.1 | Not tested (3) |
| 23% Mn | 0.4 | 1.8 | 12.3 | |
| 24 | 114.7 | 228.5 | 330.9 | 394.7 |
| 24% Mn | 5.3 | 13.8 | 18.0 | 18.4 |
| 25 | 108.0 | 238.3 | 338.9 | Not tested (3) |
| 25% Mn | 5.1 | 12.9 | 17.5 | |

EXAMPLES 26

A 25 litre bath was made up for barrel plating using the composition of example 18 with the pH adjusted to 6.6 with sodium hydroxide.

Barrel plating was carried out on steel bolts as the workpiece using one steel anode of 20×25 cms and one zinc anode of 4.5×6 cms, at 1 A/dm2, for 70 minutes at 14.6 A, 11 volts, and 25° C. The plated bolts were semi-bright in appearance with dull heads. The plating solution discoloured from pink to yellow and inspection of the steel anode showed some pitting indicating attack on the steel anode, which was confirmed by analysis of the bath which was shown to contain 43 ppm of iron.

Analysis of the deposit by ICP as for examples 1–8 indicated 15.6% manganese in the deposit, which was 8.6 micrometres thick. The plating efficiency was 43.5%.

EXAMPLES 27, 28 AND 29

Three samples of the plated bolts of example 26 were subjected to passivation for 30 seconds with PERMAPASS 3080 (Ex 27) (see Example 10 above). 3 minutes with P2 (Ex 28) (see Example 11 above) and 30 seconds with another proprietary passivate ENTHOX 7748 (Ex 29). The resulting passivated bolts were respectively "bright uniform, purply blue", "flecky iridiscent yellow" and "iridiscent yellow" in appearance.

EXAMPLE 30

Hull cell plating was carried out with the bath composition of Example 18 to which was added 50 mg/l of benzylidene acetone as the active ingredient (predissolved in isopropyl alcohol). This cave a slight improvement in brightness.

EXAMPLE 31

Hull cell plating was carried out with the bath composition of Example 18 to which was added 20 mg/l of vanilin added as the bisulphite adduct. This produced a clear improvement in brightness, especially in the high current density area.

EXAMPLE 32

The barrel plating of Example 26 was continued using the same bath but with the addition of 20 mg/l of vanilin added as the bisulphite adduct. In addition the steel anode was replaced and instead as the anodes two platinized titanium mesh anodes were used, 15×20 cms in size. ICP analysis of the alloy deposit indicated 20% manganese. The thickness was 8.8–10.3 micrometres. The plated bolts were brighter than in example 26 but the heads were still slightly dull. The passivation procedures of Examples 27–29 were repeated but the appearance of the passivated bolts did not chance.

The amount of iron in the bath at the beginning of this plating run was 43 ppm and at the end of the run had not changed, indicating that no iron was lost from the steel workpieces.

Example 32 used inert anodes and demonstrated that this sulphate process can be carried out without evolution of chlorine gas. Steel anodes should be avoided. Mixed inert and zinc anodes could be used.

EXAMPLE 33–47

Sulphate plating baths similar to Example 18 were made up with the compositions shown g/l in tables 6A. 6B and 6C below. and Hull cell plating was carried out as for examples 1–8 namely 2A but 20 minutes plating time.

TABLE 6A

| Example | 33 | 34 | 35 | 36 | 37 |
|---|---|---|---|---|---|
| Ingredient | | | | | |
| $ZnSO_4.7H_2O$ | 60 | 60 | 60 | 60 | 60 |
| $Na_2SO_4$ Anhydr. | 100 | 100 | 100 | 100 | 100 |
| $MnSO_4.1H_2O$ | 30 | 30 | 30 | 30 | 60 |
| $H_3BO_3$ | 0 | 37.5 | 37.5 | 75 | 75 |
| Na gluconate | 120 | 120 | 60 | 120 | 120 |
| Na tartrate | — | — | — | — | — |
| Na citrate | — | — | — | — | — |
| Sorbitol | — | — | — | — | — |
| TEA (1) | — | — | — | — | — |
| TEPA (2) | — | — | — | — | — |
| EDTA-2Na (3) | — | — | — | — | — |
| PEG 400 | 4 | 4 | 4 | 4 | 4 |
| pH | 6.3 | 6.6 | 6.7 | 6.6 | 6.7 |

Notes on Table 6
(1) Triethanolamine
(2) Tetra ethylene pentamine
(3) Ethylene diamine tetra acetic acid disodium salt

TABLE 6B

| Example | 38 | 39 | 40 | 41 | 42 |
|---|---|---|---|---|---|
| Ingredient | | | | | |
| $ZnSO_4.7H_2O$ | 60 | 60 | 60 | 60 | 60 |
| $Na_2SO_4$ Anhydr. | 100 | 100 | 100 | 100 | 100 |
| $MnSO_4.1H_2O$ | 30 | 30 | 30 | 30 | 30 |
| $H_3BO_3$ | 75 | 75 | 75 | 75 | 75 |
| Na gluconate | — | — | — | — | — |
| Na tartrate | 120 | — | — | — | — |
| Na citrate | — | 120 | — | — | — |
| Sorbitol | — | — | 120 | — | — |
| TEA (1) | — | — | — | 60 | — |
| TEPA (2) | — | — | — | — | 60 |
| EDTA-2Na (3) | 120 | — | — | — | — |
| PEG 400 | 4 | 4 | 4 | 4 | 4 |
| pH | 6.5 | 6.8 | 6.5 | (4) | 6.6 |

Notes on table 6B
(4) a precipitate was formed which did not redissolve so the plating was not carried out

TABLE 6C

| Example | 43 | 44 | 45 | 46 | 47 |
|---|---|---|---|---|---|
| Ingredient | | | | | |
| $ZnSO_4.7H_2O$ | 60 | 60 | 60 | 60 | 90 |
| $Na_2SO_4$ Anhydr. | 100 | 100 | 100 | 100 | 100 |
| $MnSO_4.1H_2O$ | 30 | 30 | 30 | 60 | 60 |
| $H_3BO_3$ | 75 | 75 | 75 | 75 | 75 |
| Na gluconate | — | 120 | — | 120 | 120 |
| Na tartrate | — | — | — | — | — |
| Na citrate | — | — | 120 | — | — |
| Sorbitol | — | — | — | — | — |
| TEA (1) | — | — | — | — | — |
| TEPA (2) | — | — | — | — | — |
| EDTA-2Na (3) | 120 | — | — | — | — |
| PEG 400 | 4 | 4 | 4 | 4 | 4 |
| pH | 6.9 | 6.6 | 6.6 | 6.6 | 6.6 |

EXAMPLES 48–54

A bath of the composition of example 36 was modified by adjusting it's pH. Examples 48 and 49 had pH 3.4: Ex 50 pH 5.3: Ex 51 pH 5.9: Ex 52 pH 6.4: Ex 53 pH 7.1: Ex 54 was example 36 to which was added 10 ml of N-amino ethyl ethanol amine and the pH was then adjusted to 6.5 with sodium hydroxide.

When the pH was above 7.5 a precipitate was formed.

The appearance of the Hull panels of examples 33–54 was that generally the panels show burning or non-adherent black deposits in the high current density areas. Acceptable results were only obtained with gluconate and tartrate. 120 g/l gluconate gave better uniformity than 60 g/l. 75 g/l boric acid gave better results than lower values. Higher pH values gave better results with regard to appearance especially in the low current density areas.

ICP analysis as for examples 1–8 was carried out on the Hull cell panels which had adherent deposits. The locations of the analysis on the 1×4 cm area were follows in Table 7.

TABLE 7

| Position on Hull cell panel | Cm distance from low current density edge | Comment |
|---|---|---|
| 2 | 1–2 cm | This is the low current density area |
| 4 | 3–4 cm | |
| 7 | 6–7 cm | |
| 9 | 8–9 cm | This is the high current density area |

The results of the analyses are given in Table 8 below as % manganese content of the deposit.

TABLE 8

| Hull position | 2 | 4 | 7 | 9 | Plating rate |
|---|---|---|---|---|---|
| Example | | | | | |
| 33 | 0.8 | 8.0 | | | |
| 34 | 11.3 | 18.8 | | | |
| 35 | 10.5 | 16.4 | | | |
| 36 | 14.5 | 18.7 | 25.6 | 27.6 | |
| 37 | 14.6 | 19.6 | | | |
| 38 | 15.8 | 18.2 | 21.9 | 23.7 | |
| 39 | 23.7 | 63.4 | 55.2 | 82.6 | Very low efficiency |
| 40 | 7.0 | 14.9 | | | |
| 41 | — | — | — | — | Not suitable Not plated |
| 42 | 1.7 | 3.6 | | | |
| 43 | 9.8 | | | | |
| 44 | 12.3 | 17.9 | 25.3 | | |
| 45 | 24.3 | 60.7 | | | Very low efficiency |
| 46 | 14.4 | 19.1 | | | |
| 47 | 13.9 | 19.2 | | | |
| 48 | 0.3 | 6.2 | 14.3 | 17.0 | |
| 49 | 2.7 | 14.3 | 17.3 | 20.3 | |
| 50 | 9.5 | 16.1 | 20.6 | 25.3 | |
| 51 | 14.6 | 18.9 | 23.8 | 27.1 | |
| 52 | 13.7 | 18.5 | 25.2 | 25.3 | |
| 53 | 15.6 | 20.9 | 24.3 | | |
| 54 | 0.1 | 0.1 | 0.1 | | |

The above results and ICP analyses indicate that boric acid makes the alloy distribution more uniform because it increases the % manganese content in low current density areas and the medium current density areas.

Higher gluconate amounts give slightly higher % manganese and better high current density appearance.

Tartrate gives slightly more uniform manganese distribution than gluconate.

Citrate gives high % manganese but very low efficiency.

TEPA and N-amino ethyl ethanolamine suppress the % manganese in the deposit.

Doubling the manganese concentration in the bath only produces a slight increase in % manganese in the deposit, and thus has no economic benefit.

Higher zinc plus manganese concentration in the bath produces a less uniform appearance.

Higher pH within the range up to 7.1 results in more uniform distribution of manganese in the deposit.

Sorbitol can be used as a complexor but results in less good distribution of manganese in the deposit and a less good appearance than is obtained with gluconate.

EXAMPLE 55

A 20 litre bath was made up for barrel plating using the composition set out in Table 9 below with the pH adjusted to 6.8 with sodium hydroxide.

TABLE 9

| Example | 55 |
|---|---|
| Ingredient | |
| Zinc sulphate.$7H_2O$ g/l | 60 |
| Sodium sulphate anhydrous g/l | 100 |
| Manganese sulphate.$1H_2O$ g/l | 30 |
| Boric acid ($H_3BO_3$) g/l | 75 |
| Sodium gluconate g/l | 120 |
| Benzaldehyde (as bisulphite) mg/l | 200 |

Barrel plating was carried out on steel nuts with an attached washer as the workpiece using two platinised titanium anodes of 20×25 cms and one zinc anode of 4.5×6 cms, at 1.73 A/dm$^2$, for 60 minutes at 10A, 9.5 volts, and 29° C. The solution did not change colour during electrolysis. No attack was observed on the platinised titanium anodes. The zinc anodes were attacked sufficiently to maintain the zinc concentration in the bath at a stable level. The plated nuts were grey to semi-bright in appearance.

Analysis of the deposit by ICP as for examples 1–8 indicated 17.8–18.8% manganese in the deposit, which was 10 micrometres thick. The plating efficiency was 34%.

EXAMPLES 56–65

The nuts produced by Example 55 were passivated by immersion in the passivating agents listed in Table 10A which identifies the passivates by a number P3 or P4 or by their trademark identifications and gives the pH used, the time of immersion and the resultant colour. Table 10B gives the composition of passivates P3 and P4.

TABLE 10A

| Ex | Passivate identification | pH | Time (mins) | Appearance |
|---|---|---|---|---|
| 56 | ENTHOX 775 | 1.6 | 45 | Black with some dull patches |
| 57 | P3 | 1.98 | 120 | Bright black |
| 58 | P3 | 3.0 | 120 | grey black |
| 59 | P4 | 3.0 | 120 | Bright black slightly lighter than Ex 57 |
| 60 | Frappaz Passival IP108 | 1.3 | 30 | red-yellow patchy iridescent |

TABLE 10A-continued

| Ex | Passivate identification | pH | Time (mins) | Appearance |
|---|---|---|---|---|
| 61 | Triazur 200 (Chemmetal) | 2.0 | 50 | blue with yellow patches |
| 62 | ENTHOX VOZ | 1.0 | 60 | brown, partially stripped, too aggressive, dissolves too much of the deposit. |
| 63 | ENTHOX 7778 | 1.1 | 60 | green/grey |
| 64 | IMMUNOX 3K | 2.0 | 30 | reddish blue |
| 65 | ENTHOX 961 | 2.0 | 30 | red green iridescent |
| 66 | ENTHOX 747 | 1.6 | 30 | yellow iridescent |

The passivates listed in Table 10A under trademark are commercially available under such marks. Enthox 775 is a hexavalent chromium passivate containing silver ions.

Enthox VOZ and 7778 are hexavalent chromium passivates containing inorganic acids. Enthox 961 is a hexavalent chromium passivate containing inorganic salts and an organic additive.

Enthox 747 contains chromium oxide, carboxylic acid, inorganic acid and metal salt.

Imnmunox 3K contain nitric acid and various metal salts, phosphate and fluoride.

TABLE 10B

| Passivate | P3 | P4 |
|---|---|---|
| Ingredient | | |
| $CrO_3$ g/l | 50 | 50 |
| $H_2SO_4$ (96%) ml/l | 7 | 8 |
| Acetic acid ml/l | 60 | 80 |
| Formic acid m/l | 7 | — |
| $CuSO_4.5H_2O$ g/l | 16 | 16 |

Examples 55, 56 to 61 and 63 to 66 (without any preliminary heat treatment) were then subjected to neutral salt spray testing when suspended on a grid spaced apart from each other by 2 cms 30 such nuts being treated and arranged in such a way so that drips from the top of the array did not fall on nuts at the bottom of the array.

The results are given in Table 11 below, the test being carried out as described for Table 3 and the abbreviations WCP and RR having the same meanings as given for Table 3.

TABLE 11

| Ex | Time to commencement of WCP (hrs) | Time to 5% WCP (hrs) | Time to commencement of RR (hrs) |
|---|---|---|---|
| 56 | 46 | 142 | 286 |
| 57 | 238 | 478 | 670 |
| 58 | 238 | 478 | 670 |
| 59 | 238 | 478 | 622–670 |
| 60 | 238–334 | 286–478 | 574–670 |
| 61 | 5 | 22 | 142 |
| 63 | 238 | 238 | 574–670 |
| 64 | 22 | 238 | 334 |
| 65 | 238 | 286 | 574–622 |
| 66 | 286 | 334 | 574–670 |
| 55 | 5 | 22 | 142 |

It can be seen from Table 11 that the passivates in accordance with the present invention (P3 and P4) which give a black finish also give much improved corrosion resistance as compared to the other black passivate namely ENTHOX 775 which silver ions.

EXAMPLES 56A–61A and 63A to 66A

Examples 56 to 61 and 63 to 66 were subjected to heat treatment, namely 1 hr at 120° C. This is to simulate conditions in the engine compartment where parts get exposed to elevated temperatures in automotive applications. They were then subject to neutral salt spray treatment as in Table 11 and the results are given in Table 12.

TABLE 12

| Ex | Time to commencement of WCP (hrs) | Time to 5% WCP (hrs) | Time to commencement of RR (hrs) |
|---|---|---|---|
| 56 | 5 | 5 | 142 |
| 57 | 22 | 46 | 574 |
| 58 | 142 | 238 | 621 |
| 59 | 238 | 238 | 670 |
| 60 | 46 | 142 | 334–406 |
| 61 | 22 | 22 | 142 |
| 63 | 22 | 22 | 142 |
| 64 | 22 | 46 | 334–406 |
| 65 | 22 | 22 | 238–406 |
| 66 | 142 | 142 | 478 |

The best passivation for a blue colour was achieved by Immunox 3K, for a yellow iridescent colour by Enthox 747 and for a black colour by P3 or P4.

EXAMPLE 67

Example 55 was repeated and barrel plating was carried out on 5 cm long steel screws using two platinized titanium anodes (20×25 cm) and three zinc anodes (4.5×6 cm) at 0.8A/dm$^2$ for 60 minutes at 7.4 volts, 8 Amps and 25° C. The plated screws had bright heads and points. The threaded area was grey. Analysis of the deposit by ICP as for examples 1–8 indicated 16.7% manganese in the deposit which was 6 micrometres thick. Scanning electron microscope (SEM) analysis indicated that the heads had 19.4% manganese content and the centres of the threads 6.3% manganese content.

EXAMPLES 68 to 78

The screws produced by Example 67 were passivated with the same passivates under the same conditions as given in Table 10 with the same appearances being produced.

The screws of examples 67, and 68 to 76 (without any preliminary heat treatment) were then subjected to neutral salt spray testing as for examples 55, 56 to 61 and 63 to 66 and the results are given in Table 13.

TABLE 13

| Ex | Time to commencement of WCP (hrs) | Time to 5% WCP (hrs) | Time to commencement of RR (hrs) |
|---|---|---|---|
| 68 | 192 | 192 | 288–360 |
| 69 | 192 | 192 | 360–528 |
| 70 | 192 | 192 | 360–528 |
| 71 | 192 | 192 | 528–648 |
| 72 | 192 | 192 | 432–576 |
| 73 | 96 | 96 | 192 |
| 74 | 192 | 192 | 360–576 |
| 75 | 192 | 192 | 360–576 |
| 76 | 192 | 240 | 432–576 |
| 67 | <96 | <96 | 96 |

EXAMPLES 68A TO 76A

Examples 68 to 76 were subjected to heat treatment, namely 1 hr at 120° C. to anneal the coatings. They were then subjected to neutral salt spray treatment as in Table 11 and the results are given in Table 14.

TABLE 14

| Ex | Time commencement of WCP (hrs) | Time to 5% WCP (hrs) | Time to commencement of RR (hrs) |
|---|---|---|---|
| 68A | 96 | 96 | 192 |
| 69A | 96 | 192 | 528 |
| 70A | 96 | 192 | 720 |
| 71A | 96 | 192 | >720 |
| 72A | 192 | 192 | 720 |
| 73A | 96 | 96 | 192 |
| 74A | 96 | 192 | 528 |
| 75A | 96 | 192 | 720 |
| 76A | 96 | 192 | 576 |

For Examples 68 to 76 the best black colour is obtained in Example 68. Examples 69–71 are slightly more brown.

A comparison of Tables 13 and 14 with Tables 11 and 12 indicate that heating the screws improved resistance to red rust though white corrosion was slightly worse overall. This effect was not observed with the nuts.

The overall conclusions on passivation is that Permapass Immunox 3K (Ex 64) gives better appearance and corrosion results than Chemmetal Triazur 200 (ex 61). For iridescent passivation Enthox 747 (Ex 66) gives the best results.

The best black colour is with Enthox 775 (Ex 56) but P3 or P4 (Ex 57. 58 and 59) give much better corrosion results but with a slightly brownish black colour.

EXAMPLES 77–96

The Hull plating procedures used for Examples 1–8 were carried out on the compositions given in Tables 15A, 15B, 15C and 15D set out below.

TABLE 15A

| Example | 77 | 78 | 79 | 80 | 81 |
|---|---|---|---|---|---|
| Ingredient | | | | | |
| $ZnSO_4.7H_2O$ | 60 | 60 | 60 | 60 | 60 |
| $Na_2SO_4$ Anhydr. | 100 | 100 | 100 | 100 | 100 |
| $MnSO_4.1H_2O$ | 30 | 30 | 30 | 30 | 60 |
| $H_3BO_3$ | 75 | 75 | 75 | 75 | 75 |
| Na gluconate | 120 | 120 | 120 | 120 | 120 |
| Heliotropine (as bisulphite) ppm | — | — | 200 | — | — |
| Benzaldehyde (as bisulphite) ppm | — | — | — | 200 | — |
| Salicylaldehyde (as bisulphite) ppm | — | — | — | — | 200 |
| PEG 400 ml/l | — | 4 | — | — | — |
| Ph | 6.8 | 6.8 | 6.8 | 6.8 | 6.8 |

TABLE 15B

| Example | 82 | 83 | 84 | 85 | 86 |
|---|---|---|---|---|---|
| Ingredient | | | | | |
| $ZnSO_4.7H_2O$ | 60 | 60 | 60 | 60 | 60 |
| $Na_2SO_4$ Anhydr. | 100 | 100 | 100 | 100 | 100 |
| $MnSO_4.1H_2O$ | 30 | 30 | 30 | 30 | 60 |
| $H_3BO_3$ | 75 | 75 | 75 | 75 | 75 |
| Na gluconate | 120 | 120 | 120 | 120 | 120 |

TABLE 15B-continued

| Example | 82 | 83 | 84 | 85 | 86 |
|---|---|---|---|---|---|
| Heliotropine (as bisulphite) ppm | 200 | — | 200 | — | — |
| Benzaldehyde (as bisulphite) ppm | — | — | — | 200 | — |
| Salicylaldehyde (as bisulphite) ppm | — | — | — | — | 200 |
| $SeO_2$ ppm | — | 400 | — | — | — |
| KSCN g/l | — | — | 4 | 4 | — |
| ESA/EK 20289 g/l | — | — | — | — | 4 |
| PEG 400 (ml/l) | 4 | — | — | 4 | — |
| pH | 6.8 | 6.8 | 6.8 | 6.8 | 6.8 |

TABLE 15C

| Example | 87 | 88 | 89 | 90 |
|---|---|---|---|---|
| Ingredient | | | | |
| $ZnSO_4.7H_2O$ | 60 | 60 | 60 | 60 |
| $Na_2SO_4$ Anhydr. | 100 | 100 | 100 | 100 |
| $MnSO_4.1H_2O$ | 30 | 30 | 30 | 30 |
| $H_3BO_3$ | 75 | 75 | 75 | 75 |
| Na gluconate | 120 | 120 | 120 | 120 |
| Heliotropine (as bisulphite) ppm | — | — | 200 | — |
| Benzaldehyde (as bisulphite) ppm | — | — | — | 200 |
| Salicylaldehyde (as bisulphite) ppm | — | — | — | — |
| $SeO_2$ ppm | — | — | — | — |
| KSCN g/l | — | — | — | — |
| ESA/EK 20289 g/l (1) | 4 | — | — | — |
| TMP gl/l (2) | — | 10 | 10 | — |
| PT-5 ml/l (3) | — | — | 2 | 2 |
| PEG 400 (ml/l) | — | — | — | — |
| pH | 6.8 | 6.8 | 6.8 | 6.8 |

TABLE 15D

| Example | 91 | 92 | 93 | 94 | 95 | 96 |
|---|---|---|---|---|---|---|
| Ingredient | | | | | | |
| $ZnSO_4.7H_2O$ | 60 | 60 | 60 | 60 | 60 | 60 |
| $Na_2SO_4$ Anhydr. | 100 | 100 | 100 | 100 | 100 | 100 |
| $MnSO_4.1H_2O$ | 30 | 30 | 30 | 30 | 60 | 60 |
| $H_3BO_3$ | 75 | 75 | 75 | 75 | 75 | 75 |
| Na gluconate | 120 | 120 | 120 | 120 | 120 | 120 |
| Heliotropine (8) (as bisulphite) ppm | — | — | — | 200 | — | — |
| Benzaldehyde (as bisulphite) ppm | — | — | — | — | — | — |
| Salicylaldehyde (as bisulphite) ppu | — | — | — | — | — | — |
| $SeO_2$ ppm | — | — | — | — | — | — |
| KSCN g/l | — | — | — | — | — | — |
| ESA/EK 20289 g/l (1) | — | — | — | — | — | — |
| TMP g/l (2) | — | — | — | — | — | — |
| PT-5 ml/l (3) | — | — | — | — | — | — |
| Lugalvan HS1000 g/l (4) | — | 4 | — | — | — | — |
| Rewoquat CPEM g/l (5) | — | — | 5 | — | — | — |
| Anisaldehyde as bisulphite ppm (6) | — | — | — | — | 200 | — |

TABLE 15D-continued

| Example | 91 | 92 | 93 | 94 | 95 | 96 |
|---|---|---|---|---|---|---|
| C-36 (7) ml/l | — | — | — | — | — | 1 |
| PEG 400 (ml/l) | 4 | 4 | 4 | 4 | 4 | 4 |
| pH | 6.8 | 6.8 | 6.8 | 6.8 | 6.8 | 6.8 |

Notes on Table 15

(1) ESA/EK 20289 is supplied by Bayer and is described as a quaternary amine product (2) TMP is trimethylolpropane (3) PT-5 is a quaternary poly alkylene imine (4) Lugalvan HS 1000 is a thio diglycolethoxylate (5) Rewoquat CPEM is (N-methyl-N-pentaethoxy)-N-coco ammonium methosulphate (6) Anisaldehyde is 4-methoxy benzaldehyde (7) C-36 is 36% benzyl nicotinate solution (8) Heliotropine is piperonal also called 1,3-benzodioxole-5 carboxaldehyde Each of compositions 79 to 96 were used to plate Hull cell panels in Hull cells as described for Examples 1–8 using a zinc anode with a plating current of 2A and a plating time of 10 minutes without agitation. The example number, the appearance of the 10 cm long panels and the length of the panel exhibiting that appearance are given in Table 16. The Hull cell panels were then analysed by the ICP technique described for examples 1–8 and the example number, position of analysis, the deposit wt in mg/4 $cm^2$ area at that position (labelled "wt") and the % wt manganese content of that deposit (labelled "%") are given in Table 17.

TABLE 16

| Example | Appearance | length (cms) |
|---|---|---|
| 77 | semi bright | 8.5 |
| 78 | bright + semi bright | 8.5 |
| 79 | streaky bright | 8.5 |
| 80 | bright | 7.5 |
| 81 | bright | 8 |
| 82 | streaky bright | 9 |
| 83 | fully black | — |
| 84 | semi bright | 6 |
| 85 | semi bright | 3 |
| 86 | bright | full length |
| 87 | bright | full length |
| 88 | semi bright | 8 |
| 89 | semi bright | 8 |
| 90 | semi bright | 7 |
| 91 | irregular | 7 |
| 92 | streaky bright | 8 |
| 93 | semi bright | 8 |
| 94 | bright area | 7 |
| 95 | bright | 6 |
| 96 | brown bright | |

TABLE 17A

| Hull position | 2 | 4 | 6 | 8 |
|---|---|---|---|---|
| Example | | | | |
| 77 wt | 169 | 174 | 190 | 228 |
| 77% | 5.1 | 16.3 | 18.7 | 13.7 |
| 78 wt | 63 | 154 | 214 | 252 |
| 78% | 5.0 | 18.8 | 24.4 | 26.0 |
| 79 wt | 103 | 91 | 106 | 182 |
| 79% | 16.0 | 26.7 | 32.0 | 36.3 |
| 80 wt | 152 | 158 | 217 | 213 |
| 80% | 10.9 | 19.2 | 22.1 | 22.4 |
| 81 wt | 145 | 144 | 221 | 286 |
| 81% | 0.4 | 13.2 | 18.8 | 22.4 |
| 82 wt | 109 | 116 | 135 | 195 |
| 82% | 22.8 | 28.6 | 34.1 | 38.4 |
| 83 wt | 182 | 132 | 141 | 208 |
| 83% | 0.2 | 1.6 | 15.5 | 33.4 |
| 84 wt | 182 | 150 | 162 | 228 |
| 84% | 0.4 | 3.4 | 5.7 | 9.3 |

TABLE 17A-continued

| Hull position | 2 | 4 | 6 | 8 |
|---|---|---|---|---|
| 85 wt | 131 | 151 | 174 | 265 |
| 85% | 4.6 | 12.1 | 15.0 | 20.5 |
| 86 wt | 76 | 58 | 86 | 118 |
| 86% | 0.4 | 0.3 | 0.4 | 0.3 |
| 87 wt | 52 | 47 | 51 | 31 |
| 87% | 0.3 | 0.5 | 0.6 | 22.0 |
| 88 wt | 170 | 186 | 232 | 283 |
| 88% | 3.4 | 14.8 | 18.1 | 19.4 |
| 89 wt | 146 | 110 | 140 | 198 |
| 89% | 0.1 | 0.1 | 0.4 | 10.2 |
| 90 wt | 107 | 86 | 111 | 187 |
| 90% | 0.2 | 0.2 | 0.8 | 15.2 |

TABLE 17B

| Hull position | 2 | 4 | 6 | 8 |
|---|---|---|---|---|
| Example | | | | |
| 91 wt | 75 | 209 | 257 | 352 |
| 91% | 10.7 | 18.3 | 22.7 | 25.4 |
| 92 wt | 36 | 114 | 155 | 192 |
| 92% | 15.6 | 26.4 | 28.9 | 30.4 |
| 93 wt | 20 | 199 | 257 | 348 |
| 93% | 11.6 | 17.7 | 21.6 | 24.8 |
| 94 wt | 69 | 139 | 182 | 276 |
| 94% | 17.7 | 25.0 | 28.4 | 31.7 |
| 95 wt | 60 | 123 | 155 | 223 |
| 95% | 18.9 | 25.4 | 28.1 | 31.3 |
| 96 wt | 10 | 5 | 8 | 33 |
| 96% | 6.4 | 33.6 | 57.1 | 46.0 |

The preferred range of alloy composition is in the range 14–20% Mn. This should be as uniform as possible over the whole panel. The deposit weight i.e. the thickness should be as uniform as possible and as high as possible.

The thicker the deposit the more efficient is the process and the quicker can a desired thickness be deposited.

The passivates P3 and P4 are also effective in producing black deposits on zinc/iron alloy electrodeposits e.g. containing 0.4–0.8% by weight iron. They are also effective on zinc/cobalt alloy electrodeposits e.g. containing 0.6 to 1.2% cobalt.

They are also effective on zinc/nickel electrodeposits.

What is claimed is:

1. An aqueous electroplating bath for depositing zinc/manganese alloys on a substrate, the bath being free or substantially free of ammonium halide and of fluoroborate, and comprising:

from about 10 g/l to about 150 g/l alkali metal salt, from about 30 g/l to about 90 g/l boric acid, from about 10 g/l to about 200 g/l water soluble zinc salt, from about 10 g/l to about 50 g/l water soluble manganese salt, from about 60 g/l to about 140 g/l alkali metal gluconate or tartrate, and a base to bring the pH to the range of from about 6.1 to about 7.1.

2. The electroplating bath as claimed in claim 1, further comprising:

from about 10 g/l to about 150 g/l alkali metal salt, other than a halide, from about 40 g/l to about 90 g/l boric acid, from about 20 g/l to about 200 g/l water soluble zinc salt, from about 10 g/l to about 50 g/l water soluble manganese salt, from about 60 g/l to about 140 g/l alkali metal gluconate or tartrate, and a base to bring the pH to the range of from about 6.5 to about 6.9.

3. The electroplating bath as claimed in claim 2, which is made up from about 75 g/l to about 125 g/l of alkali metal salt.

4. The electroplating bath as claimed in claim 2, which is made up from about 50 g/l to about 70 g/l boric acid.

5. The electroplating bath as claimed in claim 2, which is made up from about 50 g/l to about 90 g/l water soluble zinc salt.

6. The electroplating bath as claimed in claim 2, which is made up from about 20 g/l to about 40 g/l water soluble manganese salt.

7. The electroplating bath as claimed in claim 2, which is made up from about 110 g/l to about 130 g/l alkali metal gluconate or tartrate.

8. The electroplating bath as claimed in claim 2, which is made up from benzaldehyde as bisulphite in an amount of from about 50 mg/l to about 500 mg/l.

9. The electroplating bath as claimed in claim 2, which is made up from trimethylolpropane in an amount of from about 1 g/l to about 50 g/l.

10. The electroplating bath as claimed in claim 1, which is made up from alkali metal hydroxide to bring the pH to the range of from about 6.3 to about 6.9.

11. An aqueous electroplating bath which comprises:

from about 15 g/l to about 170 g/l sulphate ions, from about 4 g/l to about 50 g/l zinc ions, from about 3 g/l to about 16 g/l manganese ions, from about 35 g/l to about 90 g/l borate ions, from about 50 g/l to about 150 g/l gluconate or tartrate ions, and a pH in the range of from about 6.1 to about 7.2.

12. The electroplating bath as claimed in claim 11, which comprises:

from about 55 g/l to about 75 g/l zinc sulphate heptahydrate, from about 20 g/l to about 40 g/l manganese sulphate monohydrate, from about 90 g/l to about 110 g/l potassium sulphate, from about 65 g/l to about 85 g/l boric acid, from about 110 g/l to about 130 g/l sodium gluconate or sodium tartrate, and in that the pH is adjusted to about 6.4 to about 6.9 with a base, and in that the composition is free or substantially free of alkali metal halide, and of ammonium halide and of fluoroborate.

13. The bath of claim 12, which is made up of:

about 65 g/l zinc sulphate heptahydrate, about 30 g/l manganese sulphate monohydrate, about 100 g/l potassium sulphate, about 75 g/l boric acid, and about 120 g/l sodium gluconate or sodium tartrate.

14. The electroplating bath as claimed in claim 12, which comprises from about 175 mg/l to about 225 mg/l of benzaldehyde as bisulphite.

15. The electroplating bath composition as claimed in claim 12, which comprises from about 7.5 g/l to about 15 g/l of trimethylolpropane.

* * * * *